US007068146B2

(12) United States Patent
Sasaki et al.

(10) Patent No.: US 7,068,146 B2
(45) Date of Patent: Jun. 27, 2006

(54) VEHICLE DOOR LOCK APPARATUS

(75) Inventors: Yoshihiro Sasaki, Kobe (JP); Minoru Yoshimura, Kobe (JP)

(73) Assignee: Fujitsu Ten Limited, Kobe (JP)

( * ) Notice: Subject to any disclaimer, the term of this patent is extended or adjusted under 35 U.S.C. 154(b) by 492 days.

(21) Appl. No.: 10/246,704

(22) Filed: Sep. 19, 2002

(65) Prior Publication Data

US 2003/0057773 A1 Mar. 27, 2003

(30) Foreign Application Priority Data

Sep. 21, 2001 (JP) ..... 2001-289199

(51) Int. Cl.
*E05B 65/20* (2006.01)

(52) U.S. Cl. ..... 340/5.72; 340/528; 307/10.1; 70/264

(58) Field of Classification Search ..... 307/10.2; 340/5.72, 5.28, 528, 5.64; 70/264
See application file for complete search history.

(56) References Cited

U.S. PATENT DOCUMENTS 4,866,417 A * 9/1989 DeFino et al. ..... 340/429
5,113,182 A * 5/1992 Suman et al. ..... 340/5.28
5,568,120 A * 10/1996 LeMense et al. ..... 340/426.28
5,835,022 A * 11/1998 Amano ..... 340/5.64
5,850,173 A * 12/1998 DiCroce et al. ..... 340/426.25
5,912,631 A * 6/1999 Kusunoki ..... 340/5.64
5,965,953 A * 10/1999 Ikeda et al. ..... 307/10.2
5,973,611 A * 10/1999 Kulha et al. ..... 340/5.62
6,075,454 A * 6/2000 Yamasaki ..... 340/5.61
6,292,107 B1 * 9/2001 Yamaura et al. ..... 340/825.69
6,567,012 B1 * 5/2003 Matsubara et al. .... 340/825.72
6,670,883 B1 * 12/2003 Asakura et al. ..... 340/5.61
6,696,927 B1 * 2/2004 Flick ..... 340/426.1
6,876,292 B1 * 4/2005 Onuma et al. ..... 340/5.62

FOREIGN PATENT DOCUMENTS

JP A 5-156851 6/1993
JP A 9-72137 3/1997

* cited by examiner

*Primary Examiner*—Brian Sircus
*Assistant Examiner*—Andrew Deschere
(74) *Attorney, Agent, or Firm*—Oliff & Berridge, PLC.

(57) ABSTRACT

A vehicle door lock apparatus receives a signal from a portable transmitter and at least locks a door based on the received signal. When a door lock request is received from the transmitter and the door on the driver's seat side is closed, signals detected by door courtesy switches are monitored. When all doors of the vehicle are closed, a door lock actuator is controlled for locking all doors by a lock unit.

21 Claims, 5 Drawing Sheets

VEHICLE DOOR LOCK APPARATUS

The present disclosure relates to the subject matter contained in Japanese Patent Application No.2001-289199 filed on Sep. 21, 2001, which is incorporated herein by reference in its entirety.

BACKGROUND OF THE INVENTION

1. Field of the Invention

This invention relates to a vehicle door lock apparatus and more particularly to a vehicle door lock apparatus for locking and unlocking a door by remote operation.

2. Description of the Related Art

A vehicle door lock apparatus receives and interprets a signal transmitted from a small-sized transmitter excellent in portability and locks or unlocks a door. For example, upon reception of a lock request signal from the transmitter, the vehicle door lock apparatus places a door lock mechanism in a lock state; on the other hand, upon reception of an unlock request signal from the transmitter, the vehicle door lock apparatus places the door lock mechanism in an unlock state. Thus, the vehicle door lock apparatus enables the user to use the transmitter to lock and unlock the door from a location at a distance from the vehicle and offers high convenience to the user and thus becomes widely available.

The following two types are available as lock systems of vehicle door lock apparatus in related arts: Type a wherein the door lock mechanism is placed in a lock state only when all doors are closed and type b wherein the door lock mechanism is placed in a lock state regardless of whether doors are open or closed.

For the driver to lock doors by remote operation using the transmitter, usually the driver opens the door on the driver's seat side, gets off the vehicle, and closes the door and then uses the transmitter to transmit a lock request signal.

By the way, if a fellow passenger exists in the passenger seat or the rear seat and gets off the vehicle together with the driver and both the fellow passenger and the driver leave the vehicle, the driver needs to check that the fellow passenger gets off the vehicle and the doors on the passenger seat side and the rear seat side are closed before using the transmitter to transmit a lock request signal.

With the vehicle door lock apparatus of the type a, the door lock mechanism is placed in the lock state only if all doors are closed (namely, if one door is open, none of the doors are placed in the lock state) and therefore if the transmitter is operated for transmitting a lock request signal before the fellow passenger closes the door on the passenger seat side, the doors are not locked.

On the other hand, with the vehicle door lock apparatus of the type b, the door lock mechanism is placed in the lock state regardless of whether doors are open or closed. However, most front-door lock mechanisms adopt self-cancel (if the door lock mechanism is placed in the lock state and then the door is closed, the door is not locked) and thus if the transmitter is operated for transmitting a lock request signal before the fellow passenger closes the door on the passenger seat side, although the door lock mechanism on the passenger seat side is once placed in the lock state, the lock state is released when the door is closed, and therefore the door on the passenger seat side is not locked.

Thus, if a fellow passenger exists, the driver needs to check that all doors are closed before operating the transmitter; it is extremely irksome for the driver.

JP-A-5-156851 (official gazette 1) and JP-A-9-72137 (official gazette 2) disclose means for solving the problem.

Official gazette 1 discloses an apparatus of the type wherein a portable transmitter and a vehicle-installed receiver are provided each with a transmission-reception circuit, a very faint search signal is transmitted periodically from the vehicle-installed receiver, and when the transmitter receives the search signal, it returns an ID code and when the vehicle-installed receiver receives the ID code, the doors are unlocked; in contrast, when the vehicle-installed receiver does not receive the ID code, the doors are locked.

According to the apparatus disclosed in official gazette 1, if the driver carrying the transmitter leaves the vehicle, the transmitter becomes unable to receive the search signal from the vehicle-installed receiver and does not return the ID code. That is, the doors of the vehicle are automatically locked if the driver carrying the transmitter simply leaves the vehicle without operating the transmitter.

Therefore, if a fellow passenger exists, the need for the driver to check that all doors are closed is eliminated and thus the inconvenience of operation can be eliminated.

However, in the invention disclosed in official gazette 1, the transmitter and the vehicle-installed receiver need to be provided each with the transmission-reception circuit and there is a problem of complicating the configuration and increasing the costs.

On the other hand, official gazette 2 discloses an apparatus of the type wherein when all doors are closed, if a lock request is received from a portable transmitter, doors are locked; on the other hand, when any door is open, if a lock request is received, the doors are locked at the point in time when all doors are closed by the time a predetermined time has elapsed.

According to the apparatus disclosed in official gazette 2, if a fellow passenger exists, the driver need not wait for all doors to be closed before operating the transmitter and further the need for providing the transmitter and the vehicle-installed receiver each with the transmission-reception circuit as in the apparatus disclosed in official gazette 1 is not involved, so that a vehicle door lock apparatus that can eliminate the inconvenience of operation in a comparatively simple configuration can be provided.

However, the apparatus disclosed in official gazette 2 involves the risk of confining the transmitter in the cabin. For example, if the driver opens the door on the driver's seat side in attempting to get off the vehicle and then operates the transmitter to transmit a lock request signal with the door open, the door is locked at the point in time when the driver closes the door regardless of whether or not the driver holds the transmitter.

Thus, if the driver closes the door with the transmitter left in the cabin after operating the transmitter, the transmitter is confined in the cabin.

When the door on the driver's seat side is open, if the driver operates the transmitter in the cabin by mistake, gets off the vehicle, and closes the door with the transmitter left in the cabin without being aware of operating the transmitter, the transmitter is also confined in the cabin.

SUMMARY OF THE INVENTION

It is therefore an object of the invention to provide a vehicle door lock apparatus for making it possible to eliminate the inconvenience of operation such as checking that all doors are closed and to lessen the risk of confining a transmitter in a cabin in a simple configuration.

To the end, according to a first aspect of the invention, there is provided a vehicle door lock apparatus for at least locking a door based on a signal transmitted from a portable transmitter, having a reception unit for receiving the signal from the portable transmitter, a door open/closed state detection unit for detecting open/closed state of each of doors, a first determination unit for determining as to whether or not a door on a driver's seat side is closed when a door lock request is received from the transmitter, based on the signal received by the reception unit and a detection signal outputted from the door open/closed state detection unit, and a lock unit for conducting door locking after all doors are closed based on the signal outputted by the door open/closed state detection unit, when the door lock request is received and the first determination unit determines that the door on the driver's seat side is closed.

According to the described vehicle door lock apparatus of the first aspect of the invention, if a door lock request is received when the door on the driver's seat side is closed, "automatic lock mode" is entered. Thus, if not all doors of the vehicle are closed at the point in time, all doors are automatically locked at the later point in time when all doors are closed.

That is, the driver operates only the transmitter for transmitting a door lock request signal after closing the door on the driver's seat side, whereby the "automatic lock mode" is entered. Thus, if a fellow passenger exists, the need for the driver to wait until all doors of the vehicle are closed as with the vehicle door lock apparatus in the related art is eliminated, so that the inconvenience of operation can be eliminated.

If the door on the driver's seat side is open, the "automatic lock mode" is not entered even if a door lock request is received. Thus, if the user closes the door with the transmitter left in the cabin after operating the transmitter for transmitting a lock request signal with the door on the driver's seat side open, the door is not automatically locked. Accordingly, an accident of confining the transmitter in the cabin can be prevented from occurring.

According to a second aspect of the invention, the first determination unit determines as to whether or not the door on the driver's seat side is closed and another doors is open when the door lock request is received. The lock unit conducts door locking after all doors are closed when the door lock request is received and the first determination unit determines that the door on the driver's seat side is closed and another door is open.

According to the described vehicle door lock apparatus of the second aspect, when the door on the driver's seat side is closed and any other door is open, if a door lock request is received, door locking is automatically conducted after all doors are closed later. That is, when the door on the driver's seat side is closed and any other door is open, if a door lock request is received, the "automatic lock mode" is entered.

That is, if the door on the driver's seat side is open, the "automatic lock mode" is not entered even if a door lock request is received. Thus, if the user'closes the door with the transmitter left in the cabin after operating the transmitter for transmitting a lock request signal with the door on the driver's seat side open, the door is not automatically locked. Accordingly, an accident of confining the transmitter in the cabin can be prevented from occurring.

When the door on the driver's seat side is closed and any other door is open, if a door lock request is received, the "automatic lock mode" is entered. Thus, if not all doors of the vehicle are closed at the point in time, all doors are automatically locked at the later point in time when all doors are closed.

That is, if any other door than the door on the driver's seat side, the driver operates only the transmitter for transmitting a door lock request signal after closing the door on the driver's seat side, whereby the "automatic lock mode" is entered. Thus, if a fellow passenger exists, the need for the driver to wait until all doors of the vehicle are closed as with the vehicle door lock apparatus in the related art is eliminated, so that the inconvenience of operation can be eliminated.

According to a third aspect of the invention, the lock unit does not conduct door locking when the door lock request is not received by the time a predetermined time has elapsed since the door on the driver's seat side is closed.

By the way, the case where the driver performs door locking by remote operation with the transmitter usually seems to be the case where the driver uses the transmitter to transmit a lock request signal before the expiration of a long time after the driver opens the door on the driver's seat side, gets off the vehicle, and closes the door on the driver's seat side.

Thus, the case where the transmitter is operated for transmitting a lock request signal after a long time has elapsed since the door on the driver's seat side was closed has a high possibility of erroneous operation.

According to the described vehicle door lock apparatus of the third aspect, even if a door lock request is received when the door on the driver's seat side is closed, door locking is not conducted when a predetermined time (for example, 10 seconds) has elapsed since the door on the driver's seat side was closed.

That is, if a door lock request is received after the expiration of the predetermined time with the door on the driver's seat side closed, the "automatic lock mode" is not entered, so that automatic door locking as the transmitter is erroneously operated can be prevented.

According to a fourth aspect of the invention, the lock unit does not conduct door locking when all doors are not closed by the time a predetermined time has elapsed since the first determination unit determines that the door on the driver's seat side is closed upon reception of the door lock request.

By the way, the case where a fellow passenger exists in the passenger seat and gets off the vehicle together with the driver and both leave the vehicle seems to be the case where a large time interval does not exist between the timing at which the door on the driver's seat side is closed and the timing at which the door on the passenger seat side is closed.

Thus, if the transmitter is operated for transmitting a door lock request signal when the door on the driver's seat side is closed, the case where any other door (for example, the door on the passenger seat side) is closed in a large time interval after the door on the driver's seat side is closed has a high possibility that the transmitter may be erroneously operated.

According to the described vehicle door lock apparatus of the fourth aspect, when the door on the driver's seat side is closed, if a door lock request is received and the "automatic lock model" is entered, door locking is not conducted when later the predetermined time (for example, 10 seconds) has elapsed.

That is, when the door on the driver's seat side is closed, if a door lock request is received and the "automatic lock mode" is entered, the "automatic lock mode" is released if later the predetermined time (for example, 10 seconds) has elapsed, so that automatic door locking as the transmitter is erroneously operated can be prevented.

According to a fifth aspect of the invention, the vehicle door lock apparatus further includes a first notification unit for giving a predetermined notification to user when the door lock request is received and the first determination unit determines that the door on the driver's seat side is closed and another door is open.

By the way, according to any of the described vehicle door lock apparatus of any one of the first to fourth aspects, when the door on the driver's seat side is closed, if a door lock request is received, the "automatic lock mode" is entered. At the point in time, however, the user (for example, the driver) cannot check whether or not the "automatic lock mode" is entered.

Therefore, it is considered that the user is insecure about whether or not automatic door locking is conducted normally. Thus, it is important not to make the user insecure by informing the user that the "automatic lock mode" is entered.

According to the described vehicle door lock apparatus of the fifth aspect, the user is informed that the "automatic lock mode" is entered, so that the user can be made to ensure that the "automatic lock mode" is entered. As the predetermined notification, flashing a hazard flasher, etc., a predetermined number of times, producing a buzzer sound a predetermined number of times, or the like can be named.

According to a sixth aspect of the invention, the vehicle door lock apparatus further includes a second notification unit for notifying user that all doors are locked when the lock unit locks all doors of a vehicle.

According to the described vehicle door lock apparatus of the sixth aspect, the user is informed that door locking in the "automatic lock mode" is complete, so that the user can easily check that door locking is complete.

According to a seventh aspect of the invention, the vehicle door lock apparatus further includes a third notification unit for giving a predetermined notification to user until a predetermined time period has elapsed when the door lock request is received and the first determination unit determines that the door on the driver's seat side is closed and another door is open.

According to an eighth aspect of the invention, termination of the predetermined time period is time when all doors of the vehicle is closed.

According to a ninth aspect of the invention, when the door lock request is received and the first determination unit determines that all doors are closed, the third notification unit does not give the predetermined notification.

According to any of the described vehicle door lock apparatus of the seventh to ninth aspects, when the door on the driver's seat side is closed, if a door lock request is received and the "automatic lock mode" is entered, the predetermined notification is given to the user until the predetermined time period has elapsed. That is, the predetermined time period is the time period during which the "automatic lock mode" is entered, whereby the users can be informed that the "automatic lock mode" is entered.

According to the described vehicle door lock apparatus of the eighth aspects, the termination of the predetermined time period is the time when all doors of the vehicle have been closed, so that the predetermined notification can be made until the "automatic lock mode" is released.

Therefore, the user can be informed that the "automatic lock mode" is entered.

By the way, when the "automatic lock mode" is entered, if all doors of the vehicle are closed, all doors are locked immediately when the "automatic lock mode" is entered, and the "automatic lock mode" is released. Thus, the user needs to be informed that the "automatic lock mode" is entered if a door is open when the "automatic lock mode" is entered.

According to the described vehicle door lock apparatus of the ninth aspect, when the door on the driver's seat side is closed, if a door lock request is received and the "automatic lock mode" is entered, whether or not a door is open is determined and if it is determined that a door is open, the predetermined notification is given to the user for informing the user that the "automatic lock mode" is entered. However, when a lock request is received, if all doors are closed, the notification is not made.

Therefore, if no notification is required, the predetermined notification is not made, so that an apparatus excellent in practicality can be provided.

According to a tenth aspect of the invention, the lock unit has a second determination unit for determining as to whether or not a predetermined operation is performed after the first determination unit determines that the door on the driver's seat side is closed when the door lock request is received. When the second determination unit determines that the predetermined operation is performed, the lock unit does not perform door locking.

According to an eleventh aspect of the invention, the predetermined operation is to open the door on the driver's seat side.

According to a twelfth aspect of the invention, the predetermined operation is the door unlock request from the transmitter.

According to any of the described vehicle door lock apparatus of the tenth to twelfth aspects, when the door on the driver's seat side is closed, if a door lock request is received, the "automatic lock mode" is entered. However, the user performs the predetermined operation such as opening the door on the driver's seat side or transmitting an unlock request from the transmitter, whereby the "automatic lock mode" can be forcibly released.

Therefore, the "automatic lock mode" can be easily released as the user desires, so that an apparatus excellent in practicality can be provided. If the door on the driver's seat side is opened after the "automatic lock mode" is entered, a problem of confining the transmitter in the cabin occurs. However, if the door on the driver's seat side is opened, the "automatic lock mode" is forcibly released, whereby confining the transmitter in the cabin can be prevented.

DETAILED DESCRIPTION OF THE PREFERRED EMBODIMENTS

Figure 1:
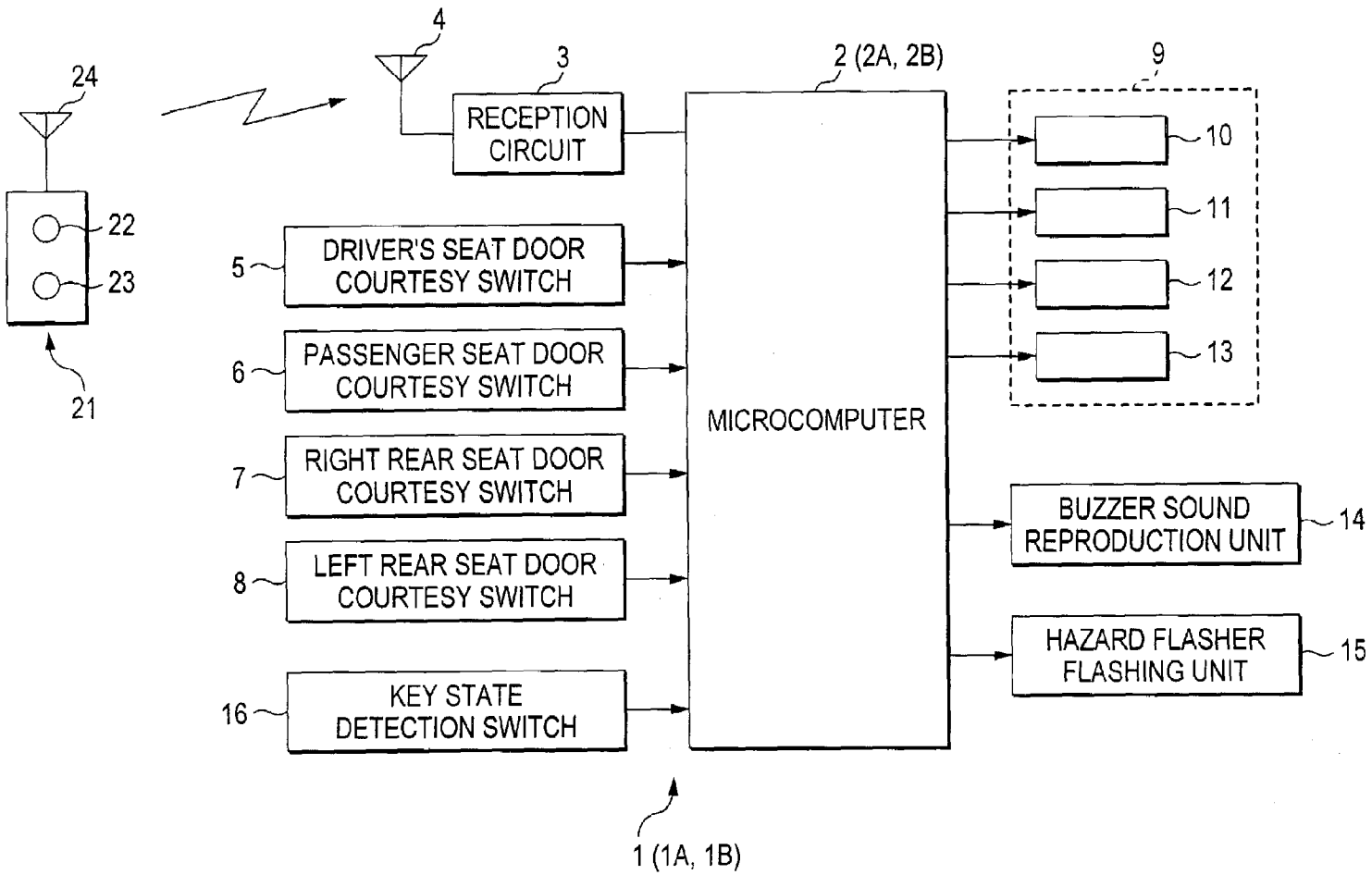
FIG. 1 is a block diagram to schematically show the main part of a vehicle door lock apparatus according to a first embodiment of the invention.

Referring now to the accompanying drawings, there are shown preferred embodiments of vehicle door lock apparatus according to the invention. FIG. 1 is a block diagram to schematically show the main part of a vehicle door lock apparatus according to a first embodiment of the invention. In the figure, numeral 1 denotes a vehicle door lock apparatus. The vehicle door lock apparatus 1 has a microcomputer 2, a reception circuit 3, and an antenna 4, and the reception circuit 3 is connected to the microcomputer 2. The reception circuit 3 can receive a signal transmitted from a transmitter 21 (described later) through the antenna 4.

Connected to an input of the microcomputer 2 are door courtesy switches 5 to 8 for detecting the open/closed state of doors (a door on the driver's seat side, a door on the passenger seat side, a door on the right rear seat side, and a door on the left rear seat side) and a key state detection switch 16 for determining as to whether or not an ignition key is inserted into a key cylinder. On the other hand, connected to an output of the microcomputer 2 are a door lock actuator 9, a buzzer sound production unit 14 for producing a buzzer sound, and a hazard flasher flashing unit 15 for flashing a hazard flasher.

The door lock actuator 9 is an actuator connected to a lock mechanism in a door and operates to the lock side or the unlock side in response to an instruction from the microcomputer 2. The door lock actuator 9 has an actuator 10 placed in the door on the driver's seat side, an actuator 11 placed in the door on the passenger seat side, an actuator 12 placed in the door on the right rear seat side, and an actuator 13 placed in the door on the left rear seat side.

The portable transmitter 21 has a microcomputer (not shown), a lock switch 22 for making a door lock request, an unlock switch 23 for making a door unlock request, a transmission circuit (not shown), and an antenna 24.

The lock switch 22 and the unlock switch 23 are connected to an input of the microcomputer and when the lock switch 22 or the unlock switch 23 is pressed, the microcomputer transmits a signal corresponding to the pressed switch through the transmission circuit from the antenna 24 to the vehicle door lock apparatus 1.

Figure 2:
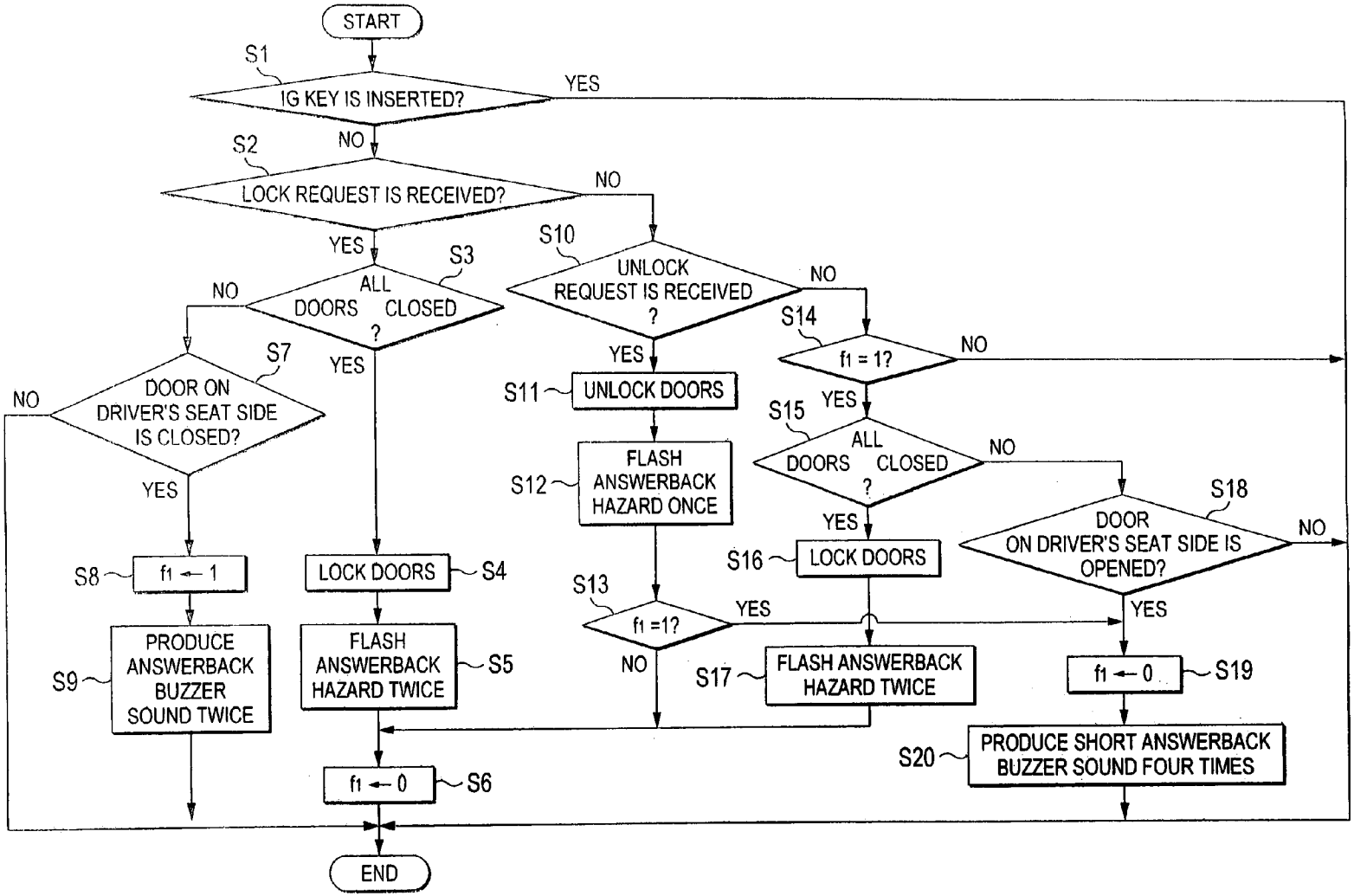
FIG. 2 is a flowchart to show the processing operation performed by a microcomputer in the vehicle door lock apparatus according to the first embodiment of the invention.

Next, processing operation (1) performed by the microcomputer 2 in the vehicle door lock apparatus 1 according to the first embodiment of the invention will be discussed with reference to a flowchart of FIG. 2. To begin with, whether or not the ignition key is inserted in the key cylinder is determined based on a signal detected by the key state detection switch 16 (step S1). If the door is locked when the ignition key is inserted in the key cylinder, there is a fear of confining the ignition key in the cabin. Thus, if it is determined that the ignition key is inserted in the key cylinder, the processing operation (1) is terminated.

On the other hand, if it is not determined at step S1 that the ignition key is inserted in the key cylinder, then whether or not a door lock request is received from the transmitter 21 is determined (step S2). If it is determined that a lock request is received, then whether all doors are closed is determined based on signals detected by the door courtesy switches 5 to 8 (step S3).

If it is determined at step S3 that all doors are closed, the door lock actuator 9 is controlled for locking all doors (step S4) and to inform the user that all doors have been locked, the hazard flasher flashing unit 15 is controlled for flashing the hazard flasher twice (step S5). Then, control goes to step S6 and a flag f1 described later is set to 0.

On the other hand, if it is determined at step S3 that at least one door is open, then whether or not the door on the driver's seat side is closed is determined based on the signal detected by the door courtesy switch 5 (step S7). If it is determined that the door on the driver's seat side is closed (namely, the door lock request is received when the door on the driver's seat side is closed), "automatic lock mode" is entered. Thus, the flag f1 indicating that the "automatic lock mode" is entered is set to 1 (step S8) and to inform the user that the "automatic lock mode" is entered, the buzzer sound production unit 14 is controlled for producing a buzzer sound twice (step S9). On the other hand, if it is determined at step S7 that the door on the driver's seat side is open, the "automatic lock mode" is not entered and thus the processing operation (1) is terminated.

If it is not determined at step S2 that a lock request is received, whether or not a door unlock request is received from the transmitter 21 is determined (step S10). If it is determined that an unlock request is received, then the door lock actuator 9 is controlled for unlocking all doors (step S11) and to inform the user that all doors have been unlocked, the hazard flasher flashing unit 15 is controlled for flashing the hazard flasher once (step S12). Then, control goes to step S13 and whether or not the automatic lock mode flag f1 is set to 1 (namely, whether or not the "automatic lock mode" is entered) is determined. If it is determined that the flag f1 is 1, control goes to step S19 (described later) to release the "automatic lock mode." If it is determined at step S13 that the flag f1 is 0, control goes to step S6 and the flag f1 is set to 0.

On the other hand, if it is not determined at step S10 that an unlock request is received, whether or not the flag f1 is set to 1 (namely, whether or not the "automatic lock mode" is entered) is determined (step S14). If it is determined that the flag f1 is 1, then whether all doors are closed is determined based on the signals detected by the door courtesy switches 5 to 8 (step S15). If it is not determined at step S14 that the flag 1 is 1 (namely, the "automatic lock mode" is not entered), the processing operation (1) is terminated.

If it is determined at step S15 that all doors are closed, the door lock actuator 9 is controlled for locking all doors (step S16) and to inform the user that all doors have been locked, the hazard flasher flashing unit 15 is controlled for flashing the hazard flasher twice (step S17). Then, control goes to step S6 and the flag f1 is set to 0.

On the other hand, if it is determined at step S15 that at least one door is open, whether or not the door on the driver's seat side is open is determined based on the signal detected by the door courtesy switch 5 (step S18). If it is determined that the door on the driver's seat side is open, the flag f1 is set to 0 (step S19) and the "automatic lock mode" is released. Next, to inform the user that the "automatic lock mode" is released, the buzzer sound production unit 14 is controlled for producing a short buzzer sound four times (step S20). On the other hand, if it is determined at step S18 that the door on the driver's seat side is closed, the processing operation (1) is terminated.

According to the vehicle door lock apparatus according to the first embodiment, if a door lock request is received when all doors of the vehicle are closed, immediately all doors are locked (see steps S2 to S4).

If a door lock request is received when at least the door on the driver's seat side is closed although not all doors of the vehicle are closed, the "automatic lock mode" is entered (see steps S2, S3, S7, and S8). Then, when all doors of the vehicle are closed, all doors are locked (see steps S14 to S16).

That is, if the door on the driver's seat side is closed, the "automatic lock mode" is entered, but if the door on the driver's seat side is open, the "automatic lock mode" is not entered. Thus, if the user closes the door with the transmitter 21 left in the cabin after pressing the lock switch 22 of the transmitter 21 with the door on the driver's seat side open, the door is not automatically locked. Accordingly, an accident of confining the transmitter 21 in the cabin can be prevented from occurring.

The driver presses only the lock switch 22 of the transmitter 21 for transmitting a door lock request signal after closing the door on the driver's seat side, whereby the "automatic lock mode" is entered. Thus, if a fellow passenger exists, the need for the driver to check that all doors of the vehicle are closed as with the vehicle door lock apparatus in the related art is eliminated, so that the inconvenience of operation can be eliminated.

If the door on the driver's seat side is opened or an unlock request is transmitted from the transmitter after the "automatic lock mode" is entered, the "automatic lock mode" is released, so that the "automatic lock mode" can be released as intended by the user. Particularly, if the door on the driver's seat side is opened after the "automatic lock mode" is entered, it means that the user again enters the cabin, and the possibility of leaving the transmitter in the cabin occurs. Therefore confining the transmitter is also prevented as the "automatic lock mode" is released.

Next, a vehicle door lock apparatus according to a second embodiment of the invention will be discussed. The vehicle door lock apparatus according to the second embodiment of the invention has a similar configuration to that of the vehicle door lock apparatus 1 previously described with reference to FIG. 1 except for the microcomputer 2 and therefore a microcomputer and the vehicle door lock apparatus having the microcomputer are denoted by different reference numerals from those previously described with reference to in FIG. 1 and other components will not be discussed again.

Figure 3:
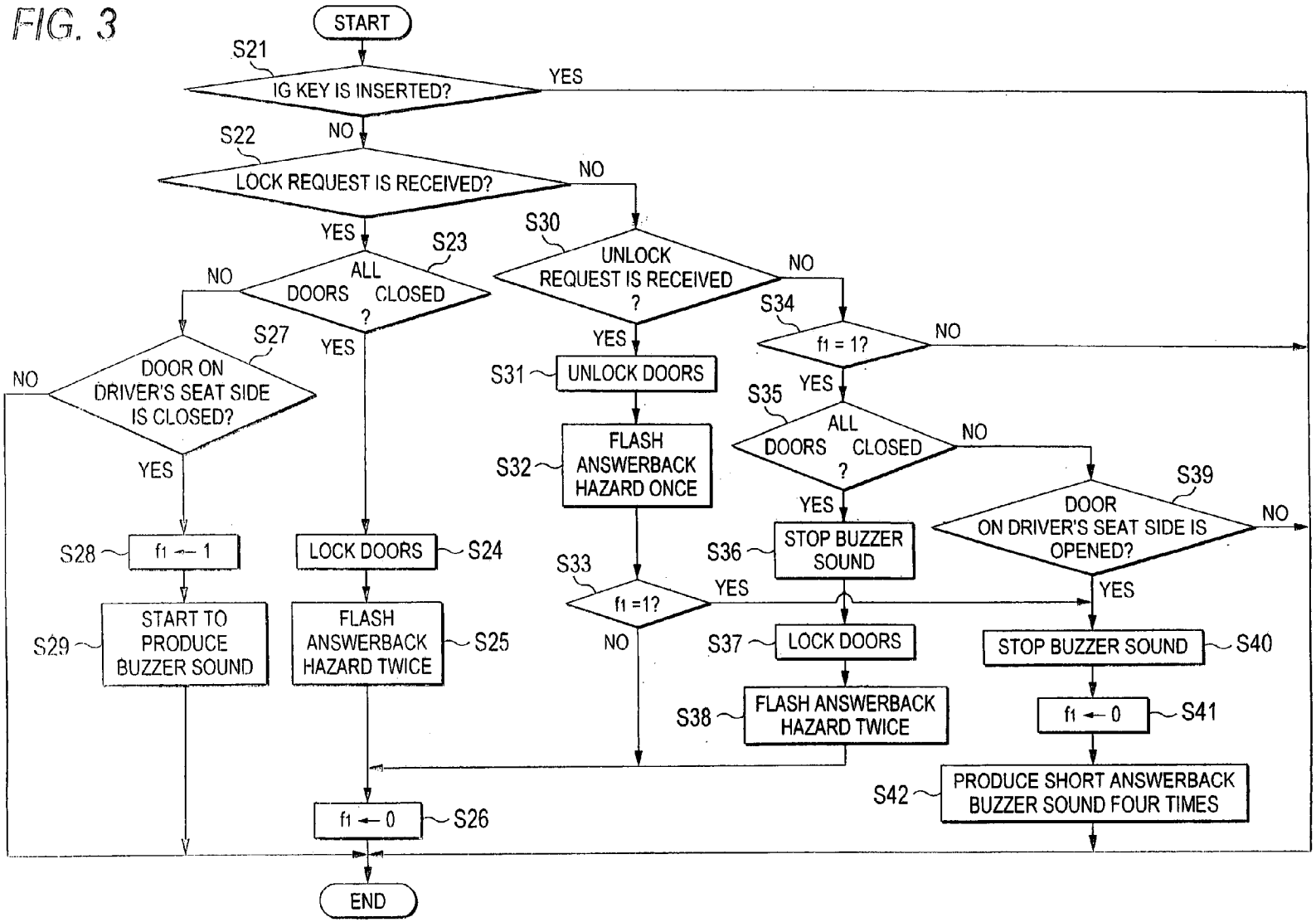
FIG. 3 is a flowchart to show the processing operation performed by a microcomputer in a vehicle door lock apparatus according to a second embodiment of the invention.

Processing operation (2) performed by the microcomputer 2A in the vehicle door lock apparatus 1A according to the second embodiment of the invention will be discussed with reference to a flowchart of FIG. 3. To begin with, whether or not an ignition key is inserted in a key cylinder is determined based on a signal detected by a key state detection switch 16 (step S21). If a door is locked when the ignition key is inserted in the key cylinder, there is a fear of confining the ignition key in the cabin. Thus, if it is determined that the ignition key is inserted in the key cylinder, the processing operation (2) is terminated.

On the other hand, if it is not determined at step S21 that the ignition key is inserted in the key cylinder, then whether or not a door lock request is received from a transmitter 21 is determined (step S22). If it is determined that a lock request is received, then whether all doors are closed is determined based on signals detected by door courtesy switches 5 to 8 (step S23).

If it is determined at step S23 that all doors are closed, a door lock actuator 9 is controlled for locking all doors (step S24) and to inform the user that all doors have been locked, a hazard flasher flashing unit 15 is controlled for flashing a hazard flasher twice (step S25). Then, control goes to step S26 and a flag f1 is set to 0.

On the other hand, if it is determined at step S23 that at least one door is open, then whether or not the door on the driver's seat side is closed is determined based on the signal detected by the door courtesy switch 5 (step S27). If it is determined that the door on the driver's seat side is closed (namely, the door lock request is received when the door on the driver's seat side is closed), "automatic lock mode" is entered. Thus, the flag f1 indicating that the "automatic lock mode" is entered is set to 1 (step S28) and to inform the user that the "automatic lock mode" is entered, a buzzer sound production unit 14 is controlled for producing a continuous buzzer sound (step S29). On the other hand, if it is determined at step S27 that the door on the driver's seat side is open, the "automatic lock mode" is not entered and thus the processing operation (2) is terminated.

If it is not determined at step S22 that a lock request is received, whether or not a door unlock request is received from the transmitter 21 is determined (step S30). If it is determined that an unlock request is received, then the door lock actuator 9 is controlled for unlocking all doors (step S31) and to inform the user that all doors have been unlocked, the hazard flasher flashing unit 15 is controlled for flashing the hazard flasher once (step S32). Then, control goes to step S33 and whether or not the automatic lock mode flag f1 is set to 1 (namely, whether or not the "automatic lock mode" is entered) is determined. If it is determined that the flag f1 is 1, control goes to step S40 (described later) to release the "automatic lock mode." If it is determined at step S33 that the flag f1 is 0, control goes to step S26 and the flag f1 is set to 0.

On the other hand, if it is not determined at step S30 that an unlock request is received, whether or not the flag f1 is set to 1 (namely, whether or not the "automatic lock mode" is entered) is determined (step S34). If it is determined that the flag f1 is 1, then whether all doors are closed is determined based on the signals detected by the door courtesy switches 5 to 8 (step S35). If it is not determined at step S34 that the flag 1 is 1 (namely, the "automatic lock mode" is not entered), the processing operation (2) is terminated.

If it is determined at step S35 that all doors are closed, the buzzer sound production unit 14 is controlled for stopping producing the buzzer sound (step S36) and then the door lock actuator 9 is controlled for locking all doors (step S37) and to inform the user that all doors have been locked, the hazard flasher flashing unit 15 is controlled for flashing the hazard flasher twice (step S38). Then, control goes to step S26 and the flag f1 is set to 0.

On the other hand, if it is determined at step S35 that at least one door is open, whether or not the door on the driver's seat side is open is determined based on the signal detected by the door courtesy switch 5 (step S39). If it is determined that the door on the driver's seat side is open, the buzzer sound production unit 14 is controlled for stopping producing the buzzer sound (step S40), the flag f1 is set to 0 (step S41), and the "automatic lock mode" is released. Next, to inform the user that the "automatic lock mode" is released, the buzzer sound production unit 14 is controlled for producing a short buzzer sound four times (step S42). On the other hand, if it is determined at step S39 that the door on the driver's seat side is closed, the processing operation (2) is terminated.

According to the vehicle door lock apparatus according to the second embodiment, if a door lock request is received when all doors of the vehicle are closed, all doors are locked (see steps S22 to S24).

If a door lock request is received when at least the door on the driver's seat side is closed although not all doors of the vehicle are closed, the "automatic lock mode" is entered (see steps S22, S23, S27, and S28). Then, when all doors of the vehicle are closed, all doors are locked (see steps S34 to S37).

That is, if the door on the driver's seat side is closed, the "automatic lock mode" is entered, but if the door on the driver's seat side is open, the "automatic lock mode" is not entered. Thus, if the user closes the door with the transmitter 21 left in the cabin after pressing the lock switch 22 of the transmitter 21 with the door on the driver's seat side open, the door is not automatically locked. Accordingly, an accident of confining the transmitter 21 in the cabin can be prevented from occurring.

The driver presses only the lock switch 22 of the transmitter 21 for transmitting a door lock request signal after closing the door on the driver's seat side, whereby the "automatic lock mode" is entered. Thus, if a fellow passenger exists, the need for the driver to check that all doors of the vehicle are closed as with the vehicle door lock apparatus in the related art is eliminated, so that the inconvenience of operation can be eliminated.

If the door on the driver's seat side is opened or an unlock request is transmitted from the transmitter after the "automatic lock mode" is entered, the "automatic lock mode" is released, so that the "automatic lock mode" can be released as intended by the user. Particularly, if the door on the driver's seat side is opened after the "automatic lock mode" is entered, it means that the user again enters the cabin, and the possibility of leaving the transmitter in the cabin occurs and therefore confining the transmitter is also prevented as the "automatic lock mode" is released.

Further, according to the vehicle door lock apparatus according to the second embodiment, a continuous buzzer sound is produced while the "automatic lock mode" is entered, so that the user can be reliably informed that the "automatic lockmode" is entered.

Next, a vehicle door lock apparatus according to a third embodiment of the invention will be discussed. The vehicle door lock apparatus according to the third embodiment of the invention has a similar configuration to that of the vehicle door lock apparatus 1 previously described with reference to FIG. 1 except for the microcomputer 2 and therefore a microcomputer and the vehicle door lock apparatus having the microcomputer are denoted by different reference numerals from those previously described with reference to in FIG. 1 and other components will not be discussed again.

Figure 4:
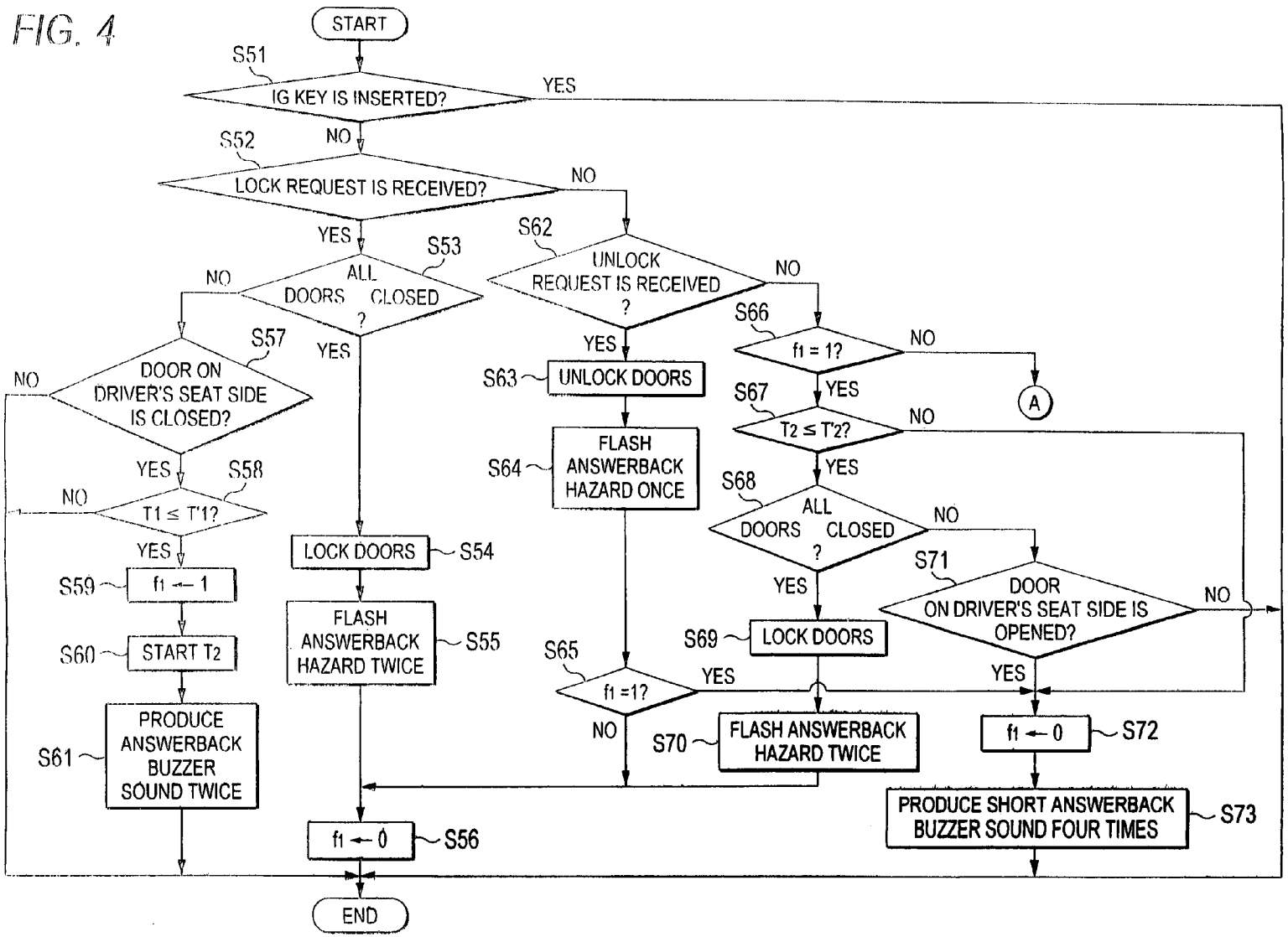
FIG. 4 is a flowchart to show the processing operation performed by a microcomputer in a vehicle door lock apparatus according to a third embodiment of the invention.
Figure 5:
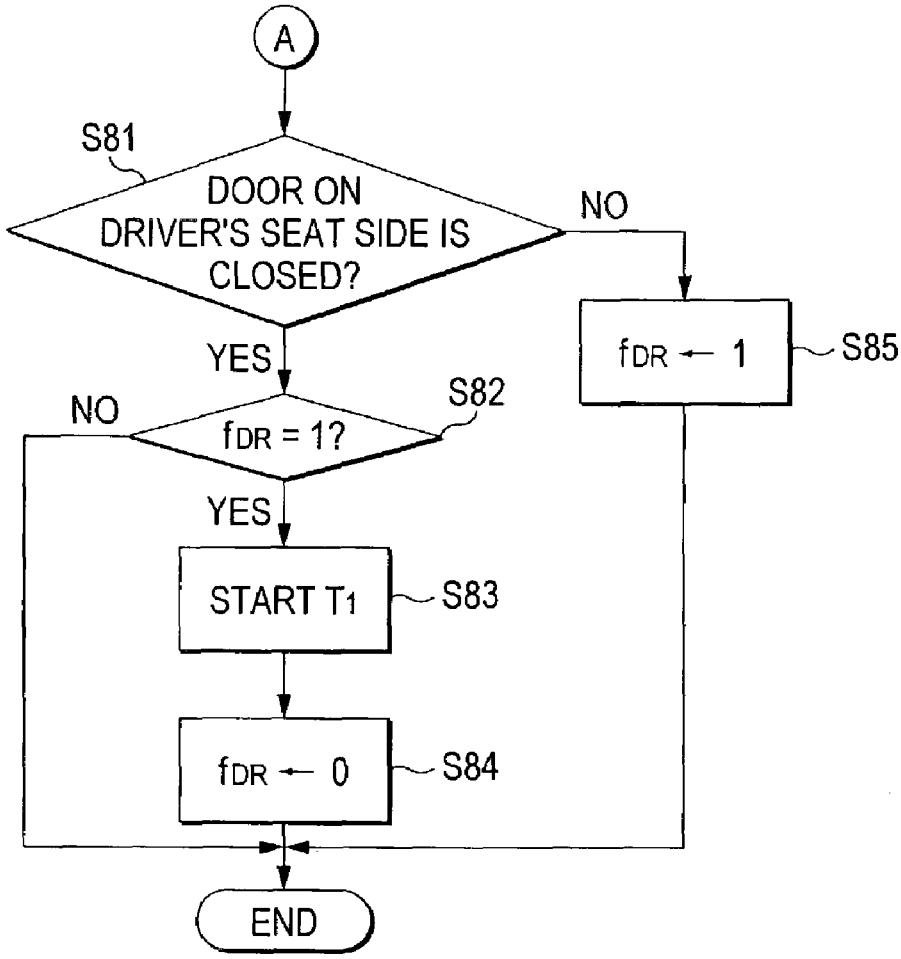
FIG. 5 is a flowchart to show the processing operation performed by the microcomputer in the vehicle door lock apparatus according to the third embodiment of the invention.

Processing operation (3) performed by the microcomputer 2B in the vehicle door lock apparatus 1B according to the third embodiment of the invention will be discussed with reference to flowcharts of FIGS. 4 and 5. To begin with, whether or not an ignition key is inserted in a key cylinder is determined based on a signal detected by a key state detection switch 16 (step S51). If a door is locked when the ignition key is inserted in the key cylinder, there is a fear of confining the ignition key in the cabin. Thus, if it is determined that the ignition key is inserted in the key cylinder, the processing operation (3) is terminated.

On the other hand, if it is not determined at step S51 that the ignition key is inserted in the key cylinder, then whether or not a door lock request is received from a transmitter 21 is determined (step S52). If it is determined that a lock request is received, then whether all doors are closed is determined based on signals detected by door courtesy switches 5 to 8 (step S53).

If it is determined at step S53 that all doors are closed, a door lock actuator 9 is controlled for locking all doors (step S54) and to inform the user that all doors have been locked, a hazard flasher flashing unit 15 is controlled for flashing a hazard flasher twice (step S55). Then, control goes to step S56 and a flag f1 is set to 0.

On the other hand, if it is determined at step S53 that at least one door is open, then whether or not the door on the driver's seat side is closed is determined based on the signal detected by the door courtesy switch 5 (step S57). If it is determined that the door on the driver's seat side is closed (namely, the door lock request is received when the door on the driver's seat side is closed), whether or not a timer T1 described later (the elapsed time since the door on the driver's seat side is placed in a closed state from an open state (see step S83)) is equal to or less than a predetermined time T1' (for example, 10 seconds) is determined (step S58).

If it is determined at step S58 that the timer T1 is equal to or less than the predetermined time T1', "automatic lock mode" is entered. Thus, the flag f1 indicating that the "automatic lock mode" is entered is set to 1 (step S59) and then a timer T2 is started (step S60). To inform the user that the "automatic lock mode" is entered, a buzzer sound production unit 14 is controlled for producing a buzzer sound twice (step S61).

On the other hand, if it is determined at step S58 that the timer T1 exceeds the predetermined time T1' (namely, the predetermined time T1' has elapsed since the door on the driver's seat side is closed), the "automatic lock mode" is not entered and thus the processing operation (3) is terminated. If it is determined at step S57 that the door on the driver's seat side is open, the "automatic lock mode" is not entered and thus the processing operation (3) is terminated.

If it is not determined at step S52 that a lock request is received, whether or not a door unlock request is received from the transmitter 21 is determined (step S62). If it is determined that an unlock request is received, then the door lock actuator 9 is controlled for unlocking all doors (step S63) and to inform the user that all doors have been unlocked, the hazard flasher flashing unit 15 is controlled for flashing the hazard flasher once (step S64). Then, control goes to step S65 and whether or not the automatic lock mode flag f1 is set to 1 (namely, whether or not the "automatic lock mode" is entered) is determined. If it is determined that the flag f1 is 1, control goes to step S72 (described later) to release the "automatic lock mode." If it is determined at step S65 that the flag f1 is 0, control goes to step S56 and the flag f1 is set to 0.

On the other hand, if it is not determined at step S62 that an unlock request is received, whether or not the flag f1 is set to 1 (namely, whether or not the "automatic lock mode" is entered) is determined (step S66). If it is determined that the flag f1 is 1, then whether or not the timer T2 is equal to or less than a predetermined time T2' (for example, 10 seconds) (step S67). If it is not determined at step S66 that the flag f1 is 1 (namely, the "automatic lock mode" is entered), control goes to step S81 (FIG. 5).

If it is determined at step S67 that the timer T2 is equal to or less than the predetermined time T2', whether all doors are closed is determined based on the signals detected by the door courtesy switches 5 to 8 (step S68). If it is determined that all doors are closed, the door lock actuator 9 is controlled for locking all doors (step S69) and to inform the user that all doors have been locked, the hazard flasher flashing unit 15 is controlled for flashing the hazard flasher twice (step S70). Then, control goes to step S56 and the flag f1 is set to 0.

On the other hand, if it is determined at step S68 that one door is open, whether or not the door on the driver's seat side is open is determined based on the signal detected by the door courtesy switch 5 (step S71). If it is determined that the door on the driver's seat side is open, the flag f1 is set to 0 (step S72) and the "automatic lock mode" is released. Next, to inform the user that the "automatic lock mode" is released, the buzzer sound production unit 14 is controlled for producing a short buzzer sound four times (step S73). On the other hand, if it is determined at step S71 that the door on the driver's seat side is closed, the processing operation (3) is terminated.

If it is determined at step S67 that the timer T2 exceeds the predetermined time T2', control goes to step S72, the flag f1 is set to 0, and the "automatic lock mode" is released. Next, to inform the user that the "automatic lock mode" is released, the buzzer sound production unit 14 is controlled for producing a short buzzer sound four times (step S73).

At step S81 (FIG. 5), whether or not the door on the driver's seat side is closed is determined based on the signal detected by the door courtesy switch 5. If it is determined that the door on the driver's seat side is closed, then whether or not a flag $f_{DR}$ indicating that the door on the driver's seat side is open is set to 1 is determined (step S82).

By the way, the determination at step S82 is made if the door on the driver's seat side is closed and therefore determining that the flag fDR is 1 means that the door on the driver's seat side was closed a moment ago.

Thus, if it is determined at step S82 that the flag $f_{DR}$ is 1 (namely, the door on the driver's seat side is placed in a closed state from an open state a moment ago), the timer T1 indicating the elapsed time since the door on the driver's seat side is placed in the closed state from the open state is started (step S83) and then the flag $f_{DR}$ is set to 0 (step S84). On the other hand, if it is determined at step S82 that the flag $f_{DR}$ is 0, the processing operation (3) is terminated.

If it is determined at step S81 that the door on the driver's seat side is open, the flag $f_{DR}$ is set to 1 (step S85).

According to the vehicle door lock apparatus according to the third embodiment, if a door lock request is received when all doors of the vehicle are closed, all doors are locked (see steps S52 to S54).

If a door lock request is received when at least the door on the driver's seat side is closed although not all doors of the vehicle are closed, the "automatic lock mode" is entered (see steps S52, S53, and S57 to S59). Then, when all doors of the vehicle are closed, all doors are locked (see steps S66 to S69).

That is, if the door on the driver's seat side is closed, the "automatic lock mode" is entered, but if the door on the driver's seat side is open, the "automatic lock mode" is not entered. Thus, if the user closes the door with the transmitter 21 left in the cabin after pressing the lock switch 22 of the transmitter 21 with the door on the driver's seat side open, the door is not automatically locked. Accordingly, an accident of confining the transmitter 21 in the cabin can be prevented from occurring.

The driver presses only the lock switch 22 of the transmitter 21 for transmitting a door lock request signal after closing the door on the driver's seat side, whereby the "automatic lock mode" is entered. Thus, if a fellow passenger exists, the need for the driver to check that all doors of the vehicle are closed as with the vehicle door lock apparatus in the related art is eliminated, so that the inconvenience of operation can be eliminated.

If the door on the driver's seat side is opened or an unlock request is transmitted from the transmitter after the "automatic lock mode" is entered, the "automatic lock mode" is released, so that the "automatic lock mode" can be released as intended by the user. Particularly, if the door on the driver's seat side is opened after the "automatic lock mode" is entered, it means that the user again enters the cabin, and the possibility of leaving the transmitter in the cabin occurs and therefore confining the transmitter is also prevented as the "automatic lock mode" is released.

Further, according to the vehicle door lock apparatus according to the third embodiment, even if a door lock request is received when the door on the driver's seat side is closed, the automatic lock mode is not entered and door locking is not conducted when the predetermined time T1' has elapsed since the door on the driver's seat side was closed.

That is, if a door lock request is received after the expiration of the predetermined time T1' with the door on the driver's seat side closed (see steps S52, S53, S57, and S58), the "automatic lock mode" is not entered, so that automatic door locking as the transmitter 21 is erroneously operated can be prevented.

When the door on the driver's seat side is closed, if a door lock request is received and the "automatic lock mode" is entered, door locking is not conducted when later the predetermined time T2' has elapsed (see steps S66, S67, and S72).

That is, when the door on the driver's seat side is closed, if a door lock request is received and the "automatic lock mode" is entered, the "automatic lock mode" is released if later the predetermined time T2' has elapsed, so that automatic door locking as the transmitter 21 is erroneously operated can be prevented.

In the embodiments, type a in the related art (wherein it is made possible to lock based on a signal of the transmitter only when all doors are closed) has been described, but the invention can be applied to type b (wherein door locking is conducted based on a signal of the transmitter if a door is open) and other types.

The answer back method is not limited to the embodiments; for example, the method of answerback at the normal door locking time (step S5, etc.,) and answerback at the door locking time in the "automatic lock mode" (step S16, etc.,) may be changed. In this case, the number of hazard flashing times may be changed or answerback is eliminated at the normal door locking time (the user checks door locking based on lock actuator operation sound) and the hazard may be flashed or a buzzer sound may be produced at the door locking time in the "automatic lock mode."

Further, in the embodiments, opening the door on the driver's seat side and an unlock request transmitted from the transmitter have been described as the "automatic lock mode" release method, but the "automatic lock mode" may be released by using different operation such as operating any other switch of the transmitter.

What is claimed is:

1. A vehicle door lock apparatus for at least locking a door based on a signal received wirelessly, comprising:

a reception unit for receiving the signal wirelessly;

a door open/closed state detection unit that detects open/closed state of each door;

a first determination unit that detects whether a door on a driver's seat side is closed when the reception unit receives a door lock request wirelessly, based on the signal received by the reception unit and a detection signal output from the door open/closed state detection unit; and a lock unit that conducts door locking after all doors are closed based on the signal outputted by the door open/closed state detection unit, when the reception unit has received the door lock request wirelessly and the first determination unit determines that the door on the driver's seat side is closed.

2. The vehicle door lock apparatus according to claim 1, wherein the first determination unit determines whether the door on the driver's seat side is closed and another door is open when the door lock request is received; and wherein the lock unit conducts door locking after all doors are closed when the door lock request is received and the first determination unit determines that the door on the driver's seat side is closed and another door is open.

3. The vehicle door lock apparatus according to claim 1, wherein the lock unit does not conduct door locking when the door lock request is not received by the time a predetermined time has elapsed since the door on the driver's seat side is closed.

4. The vehicle door lock apparatus according to claim 1, wherein the lock unit does not conduct door locking when all doors are not closed by the time a predetermined time has elapsed since the first determination unit determines that the door on the driver's seat side is closed upon reception of the door lock request.

5. The vehicle door lock apparatus according to claim 1, further comprising a first notification unit for giving a predetermined notification to a user when the door lock request is received and the first determination unit determines that the door on the driver's seat side is closed and another door is open.

6. The vehicle door lock apparatus according to claim 1, further comprising a second notification unit for notifying a user that all doors are locked when the lock unit locks all doors of a vehicle.

7. The vehicle door lock apparatus according to claim 1, further comprising a third notification unit for giving a predetermined notification to a user until a predetermined time period has elapsed when the door lock request is received and the first determination unit determines that the door on the driver's seat side is closed and another door is open.

8. The vehicle door lock apparatus according to claim 7, wherein termination of the predetermined time period is time when all doors of the vehicle are closed.

9. The vehicle door lock apparatus according to claim 7, wherein when the door lock request is received and the first determination unit determines that all doors are closed, the third notification unit does not give the predetermined notification.

10. The vehicle door lock apparatus according to claim 1, wherein the lock unit has a second determination unit for determining whether a predetermined operation is performed after the first determination unit determines that the door on the driver's seat side is closed when the door lock request is received;

wherein when the second determination unit determines that the predetermined operation is performed, the lock unit does not perform door locking.

11. The vehicle door lock apparatus according to claim 10, wherein the predetermined operation is to open the door on the driver's seat side.

12. The vehicle door lock apparatus according to claim 10, wherein the predetermined operation is the door unlock request from the transmitter.

13. The vehicle door lock apparatus according to claim 1, wherein the reception unit receives the signal wirelessly from a portable transmitter.

14. A vehicle door lock apparatus for locking a door based on receiving a wireless signal, the apparatus comprising:

a reception unit configured to receive a wireless signal;

a door open/closed state detection unit that detects open/closed state of each door; and a lock unit that waits until a predetermined condition is met before the lock unit conducts a door locking action, wherein the predetermined condition includes:

a condition that all doors are closed; and a condition that the reception unit has received the wireless signal indicating a door lock request, wherein the lock unit does not conduct the door locking action when the reception unit has not received the wireless signal indicating the door lock request by the time a predetermined time has elapsed since the door on the driver's seat side is closed.

15. A vehicle door lock apparatus for locking a door based on receiving a wireless signal, the apparatus comprising:

a reception unit configured to receive a wireless signal;

a door open/closed state detection unit that detects open/closed state of each door;

a lock unit that waits until a predetermined condition is met before the lock unit conducts a door locking action, wherein the predetermined condition includes:

a condition that all doors are closed; and a condition that the reception unit has received the wireless signal indicating a door lock request; and a first determination unit that determines whether a door on a driver's seat side is closed when the reception unit receives the wireless signal indicating the door lock request based on a detection signal output from the door open/closed state detection unit.

16. The vehicle door lock apparatus according to claim 15, wherein the first determination unit determines whether the door on the driver's seat side is closed and another door is open when the reception unit receives the wireless signal indicating the door lock request; and wherein the predetermined condition further includes a condition that the first determination unit determines that the door on the driver's seat side is closed and another door is open.

17. The vehicle door lock apparatus according to claim 15, wherein the lock unit does not conduct the door locking action when all the doors have not been closed by the time a predetermined time has elapsed since the first determination unit determines that the door on the driver's seat side is closed upon reception of the door lock request.

18. The vehicle door lock apparatus according to claim 15, further comprising a first notification unit that gives a predetermined notification to a user when the reception unit receives the wireless signal indicating the door lock request and the first determination unit determines that the door on the driver's seat side is closed and another door is open.

19. The vehicle door lock apparatus according to claim 14, further comprising a second notification unit that notifies a user that all doors are locked when the lock unit conducts the door locking action.

20. The vehicle door lock apparatus according to claim 15, further comprising a third notification unit that gives a predetermined notification to a user until a predetermined time period has elapsed when the reception unit receives the wireless signal indicating the door lock request and the first determination unit determines that the door on the driver's seat side is closed and another door is open.

21. The vehicle door lock apparatus according to claim 15, wherein the lock unit has a second determination unit that determines whether a predetermined operation is performed after the first determination unit determines that the door on the driver's seat side is closed when the reception unit receives the wireless signal indicating the door lock request; and when the second determination unit determines that the predetermined operation is performed, the lock unit does not conduct the door locking action.

* * * * *